United States Patent [19]

Katzer et al.

[11] Patent Number: 4,911,821

[45] Date of Patent: Mar. 27, 1990

[54] LUBRICANT PRODUCTION PROCESS EMPLOYING SEQUENTIAL DEWAXING AND SOLVENT EXTRACTION

[75] Inventors: James R. Katzer, Moorestown; Quang N. Le, Cherry Hill; Stephen S. Wong, Medford, all of N.J.

[73] Assignee: Mobil Oil Corporation, New York, N.Y.

[21] Appl. No.: 307,799

[22] Filed: Feb. 8, 1989

Related U.S. Application Data

[63] Continuation of Ser. No. 78,486, Jul. 27, 1987, abandoned, which is a continuation-in-part of Ser. No. 44,187, Apr. 30, 1987, abandoned, and Ser. No. 793,937, Nov. 1, 1985, abandoned.

[51] Int. Cl.[4] ..... C10G 67/04; C10G 67/14

[52] U.S. Cl. ..... 208/27; 208/18; 208/28; 208/33; 208/36; 208/61; 208/88; 208/96; 208/99

[58] Field of Search ..... 585/736, 737, 739; 208/27, 28, 30, 31, 33, 18, 46, 58, 96, 36, 61, 88, 99

[56] References Cited

U.S. PATENT DOCUMENTS

| | | | |
|---|---|---|---|
| 3,365,390 | 1/1968 | Egan et al. | 208/60 |
| 3,684,691 | 8/1972 | Arey et al. | 208/33 |
| 3,723,295 | 3/1973 | Kress | 288/87 |
| 3,730,876 | 5/1973 | Sequeira, Jr. | 208/59 |
| 3,755,138 | 8/1973 | Chen et al. | 208/111 |
| 3,764,516 | 10/1973 | Steinmetz | 208/89 |
| 3,781,196 | 12/1973 | Thompson | 208/96 |
| 3,830,723 | 8/1974 | Ladeur et al. | 208/108 |
| 4,081,352 | 3/1978 | West et al. | 208/36 |
| 4,139,494 | 2/1979 | Itoh et al. | 208/27 |
| 4,541,917 | 9/1985 | West | 208/31 |
| 4,608,151 | 8/1986 | Miller | 208/33 |
| 4,678,556 | 7/1987 | Hicks et al. | 208/33 |
| 4,749,467 | 6/1988 | Chen et al. | 208/18 |
| 4,764,266 | 8/1988 | Chen et al. | 208/96 |
| 4,770,763 | 9/1988 | Kusayanagi et al. | 208/18 |
| 4,788,378 | 11/1988 | Chang et al. | 208/27 |

*Primary Examiner*—Anthony McFarlane

*Attorney, Agent, or Firm*—Alexander J. McKillop; Charles J. Speciale; Malcolm D. Keen

[57] ABSTRACT

Lubricants of improved characteristics are produced by carrying out a solvent extraction to remove aromatic components after solvent or catalytic dewaxing. Aromatic extraction solvents such as phenol, furfural or N-methyl pyrrolidone may be used. The process is particularly useful with wax-derived lubricants produced by the hydroisomerization of a petroleum wax which has then been dewaxed.

10 Claims, No Drawings

LUBRICANT PRODUCTION PROCESS EMPLOYING SEQUENTIAL DEWAXING AND SOLVENT EXTRACTION

This application is a continuation of Ser. No. 07/078,486 filed 07/27/87, now abandoned, which is a Continuation-in-part of Ser. No. 07/044,187, filed 04/30/87, now abandoned, and also is a continuation-in-part of Ser. No. 06/793,937, filed 11/01/85, now abandoned.

FIELD OF THE INVENTION

The present invention relates to the production of lubricants of mineral oil origin which are characterized by high viscosity indices, low pour points and other desirable properties and which may be produced in good yields from readily available refinery streams. The process employs sequential dewaxing and solvent extraction.

The process by which the present lubricants may be made may include a process of the type described in Ser. No. 793,937 and accordingly, the entire contents of the specification of Ser. No. 793,937 are incorporated in this application by this reference to it. The way hydroisomerisation and dewaxing steps which may be used in the present process are described in Ser. No. 044,187 and accordingly the entire contents of Ser. No. 044,187 are incorporated in this application by this reference to it.

BACKGROUND OF THE INVENTION

Mineral oil lubricants are derived from various crude oil stocks by a variety of refining processes directed towards obtaining a lubricant base stock of suitable boiling point, viscosity, viscosity index (VI) and other characteristics. Generally, the base stock will be produced from the crude oil by distillation of the crude in atmospheric and vacuum distillation towers, followed by the separation of undesirable aromatic components and finally, by dewaxing and various finishing steps. Because aromatic components lead to high viscosity and extremely poor viscosity indices, the use of asphaltic type crudes is not preferred as the yield of acceptable lube stocks will be extremely low after the large quantities of aromatic components contained in such crudes have been separated out; paraffinic and naphthenic crude stocks will therefore be preferred but aromatic separation procedures will still be necessary in order to remove undesirable aromatic components. In the case of the lubricant distillate fractions, generally referred to as the neutrals, e.g. heavy neutral, light neutral, etc., the aromatics will be extracted by solvent extraction using a solvent such as phenol, furfural, N-methylpyrolidone or another material which is selective for the extraction of the aromatic components. If the lube stock is a residual lube stock, the asphaltenes will first be removed in a propane deasphalting (PDA) step followed by solvent extraction of residual aromatics to produce a lube generally referred to as bright stock.

The solvent extraction to remove undesirable aromatic components is normally followed by a dewaxing step which is normally necessary in order for the lubricant to have a satisfactorily low pour point and a cloud point, so that it will not solidify or precipitate the less soluble paraffinic components under the influence of low temperatures. A number of dewaxing processes are known in the petroleum refining industry and of these, solvent dewaxing with solvent such as methylethylketone (MEK) and liquid propane, has been the one which has achieved the widest use in the industry. Recently, however, proposals have been made for using catalytic dewaxing processes for the production of lubricating oil stocks and these processes possess a number of advantages over the conventional solvent dewaxing procedures. The catalytic dewaxing processes which have been proposed are generally similar to those which have been proposed for dewaxing the middle distillate fractions such as heating oils, jet fuels and kerosenes, of which a number have been disclosed in the literature, for example, in Oil and Gas Journal, Jan. 6, 1975, pp. 69–73 and U.S. Pat. Nos. RE 28,398, 3,956,102 and 4,100,056. At least one of these processes, the Mobil Lube Oil Dewaxing Process (MLDW) has now reached maturity and is capable of producing low pour point oils not attainable by solvent dewaxing. See 1986 Refining Process Handbook, Gulf Publishing Co., (Sept. 1986 Hydrocarbon Processing), page 90.

Generally, these catalytic dewaxing processes operate by selectively cracking the longer chain end paraffins to produce lower molecular weight products which may then be removed by distillation from the higher boiling lube stock. The catalysts which have been proposed for this purpose have usually been zeolites which have a pore size which admits the straight chain, waxy n-paraffins either alone or with only slightly branched chain paraffins but which exclude more highly branched materials and cycloaliphatics. Zeolites such as ZSM-5, ZSM-11, ZSM-12, ZSM-22, ZSM-23, and the synthetic ferrierites ZSM-35 and ZSM-38 have been proposed for this purpose in dewaxing processes, as described in U.S. Pat. Nos. 3,894,938, 4,176,050, 4,181,598, 4,222,855, 4,229,282 and 4,247,388. A dewaxing process employing synthetic offretite is described in U.S. Pat. No. 4,259,174. The relationship between zeolite structure and dewaxing properties is discussed in J. Catalysis 86, 24–31 (1984).

Although the catalytic dewaxing processes are commercially attractive because they do not produce quantities of solid paraffin wax which presently is regarded as an undesirable, low value product, they do have certain disadvantages and because of this, certain proposals have been made for combining the catalytic dewaxing processes with other processes in order to produce lube stocks of satisfactory properties. For example, U.S. Pat. No. 4,181, 598 discloses a method for producing a high quality lube base stock by subjecting a waxy fraction to solvent refining, followed by catalytic dewaxing over ZSM-5 with subsequent hydrotreatment of the product. U.S. Pat. No. 4,428,819 discloses a process for improving the quality of catalytically dewaxed lube stocks by subjecting the catalytically dewaxed oil to a hydroisomerization process which removes residual quantities of petrolatum wax which contribute to poor performance in the Overnight Cloud Point test (ASTM D2500-66).

As mentioned above, the conventional catalytic dewaxing processes using intermediate pore size zeolites such as ZSM-5 operate by selectively cracking the waxy components of the feed. This results in a loss in yield since the components which are in the desired boiling range undergo a bulk conversion to lower boiling fractions which, although they may be useful in other products, must be removed from the lube stock. A notable advance in dewaxing process is described in U.S. Pat. Nos. 4,419,220 and 4,518,485, in which the waxy components of the feed, comprising straight chain and slightly branched chain paraffins, are removed by isomerization over a catalyst based on zeolite beta. During the isomerization, the waxy components are converted to relatively less waxy isoparaffins and at the same time, the slightly branched chain paraffins undergo isomerization to more highly branched aliphatics. A measure of cracking does take place during the operation so that not only is the pour point reduced by reason of the isomerization but, in addition, the heavy ends undergo some cracking or hydrocracking to form liquid range materials which contribute to a low viscosity product. The degree of cracking is, however, limited so as to maintain as much of the feedstock as possible in the desired boiling range. As mentioned above, this process uses a catalyst which is based on zeolite beta, together with a suitable hydrogenation-dehydrogenation component which is typically a base metal or a noble metal, usually of group VIA or VIIIA of the Periodic Table of the Elements (the periodic table used in this specification is the table approved by IUPAC), such as cobalt, molybdenum, nickel, tungsten, palladium or platinum. As described in U.S. Pat. No. 4,518,485, the isomerization dewaxing step may be proceded by a hydrotreating step in order to remove heteroatom-containing impurities, which may be separated in an interstage separation process similar to that employed in two-stage hydrotreating-hydrocracking processes.

With the present trend to more severe service ratings, there is a need to develop better lubricants. For example, the SAE service ratings of SD and SE are becoming obsolescent as more engine manufacturers specify an SF rating and it is expected that even more severe ratings will need to be met in the future as engine core temperatures increase in the movement toward greater engine efficiency. This progressive increase in service severity is manifested by improved resistance to oxidation at high temperatures and by higher V.I. requirements to ensure that the lubricants will have adequate viscosity at high temperatures without excessive viscosity when the engine is cold. In part, the improved performance may be obtained by improved additive technology but significant advances will be needed in basestock performance to accommodate more severe service requirements.

Because of their highly paraffinic nature, the waxes produced during conventional solvent dewaxing processes have been considered for use as lubestocks. Being highly paraffinic they have excellent V.I. but their high melting point generally precludes their use as automotive lubricants. Attempts have, however, been made to use them after suitable processing. The article by Bull in Developments in Lubrication PD 19(2), 221–228 describes a process which subjects slack wax from a solvent (MEK-toluene) dewaxing unit to severe hydrotreating in a blocked operation together with other base stocks to produce high viscosity index (HVI) base oils. The promise of the process does not, however, appear to have been fully realized in practice since high V.I. oils of low pour point have not become commercially available. U.S. Pat. No. 4,547,283 describes a process for hydroisomerizing petroleum waxes such as slack wax using a specific type of catalyst treated with certain reactive metal compounds such as tetramethyl ammonium aluminate. Although high V.I. values are reported for the hydroisomerized wax products it is by no means clear that low pour points have been secured and accordingly it seem that the objective of matching low pour point with high V.I. in a lubricant of mineral oil origin has still to be met. A related proposal to use Foots Oil (the mixed oil/wax product of de-oiling slack wax) as a lube feedstock by dewaxing it over an intermediate pore size zeolite such as ZSM-5 is made in U.S. Pat. No. 3,960,705 but the products had relatively high pour points and the reported V.I. values do not exceed 107.

In application Ser. No. 793,937 a process for producing high V.I., low pour point lubes from various paraffinic feeds such as slack wax or waxy gas oils such as the South East Asian gas oils is described. The process employs a first step in which a partial catalytic dewaxing is carried out with a zeolitic dewaxing catalyst which converts the waxy paraffin components is less waxy, high V.I. iso-paraffins. A subsequent, highly selective catalytic dewaxing carried out using a highly shape selective dewaxing catalyst such as ZSM-23.

Ser. No. 044,187 describes lubricant products of extremely high quality which may be produced by a process of the type described in application Ser. No. 793,937, using petroleum waxes as the feed. The lubricant products described here are characterized by high viscosity index (V.I.), low pour point (ASTM D-97) and retain their fluidity at low temperatures. These lubricants have a minimum V.I. of 130 and in most cases even higher values may be attained. Typical V.I. values are at least 140 and may even exceed 150 e.g., 155. The low temperature properties of the oils are outstanding-:pour point (ASTM D-97) is no higher than 5° F. (−5° C.) and is typically below 0° F. (about −18° C.) and the Brookfield viscosity is less than 2500 P. at −20° F. (about −29° C.) for the basestock, i.e., additive-free stock. As manifested by the excellent high V.I., the relationship between temperature and viscosity is characterized by a relatively low decrease in viscosity with increasing temperature: at 40° C., viscosity is typically no higher than 25 cSt. while at 100° C. it is no less than 5.0 cSt and usually is higher e.g., 5.3 cSt.

These lubricants may be produced from petroleum waxes by a process of sequential hydroisomerization and hydrodewaxing as described in Ser. No. 793,937, followed by hydrotreating to remove residual aromatics and to stabilize the dewaxed product. Alternatively, the wax may first be deoiled to remove aromatics and the deoiled wax subjected to the hydroisomerization-hydrodewaxing sequence of Ser. No. 793,937 to produce the final lube base stock.

The lubricants described in Ser. Nos. 793,937 and 044,187 are highly paraffinic in nature by reason of their wax origin. One minor problem which may be encountered with them is that their relatively low level of aromatic components may make certain aromatic type additives such as antioxidants and antiwear agents rather less soluble than they would be in lubricants with a slightly higher aromatic character Thus, in the final hydrotreating step it may be desirable to operate under conditions which permit some aromatics to be retained in order to improve additive solubility even though this may compromise the oxidative stability of the final lubricant.

Clearly, it would be desirable to avoid this need for compromise so that adequate additive solubility could be obtained while retaining satisfactory oxidative stability.

SUMMARY OF THE INVENTION

It has now been found that if the aromatics are extracted from a lubricant after the dewaxing step by a solvent extraction technique, the product is superior to that obtained with post-dewaxing hydrotreatment. The extracted lube product has been found to possess oxidative stability equivalent to that of dewaxed lubes subjected to high pressure hydrotreating, even though the aromatics concentration in the extracted product may be higher. In addition, the viscosity of the extracted lube may be equivalent or higher than that observed with a lube prepared by post-dewaxing hydrotreatment. The higher aromatics content may also improve the solubility of various additives.

According to the present invention there is therefore provided a method for preparing a lubricant of improved viscosity, viscosity index and additive-solubilising characteristics by subjecting a dewaxed lubricant fraction to a solvent extraction to effect removal of aromatic components. Desirably, only a portion of the aromatic components, typically up to one half will be removed during this solvent extraction step.

The present method is of particular utility with lubricants produced by the process of Ser. No. 044,187 where the feed has been a slack wax i.e. a feed which contains aromatic components from the oil entrained with the wax during its separation. These aromatic components tend to remain in the the oil to a greater or lesser extent during the hydroisomerisation-dewaxing steps in the processing of the feed and are present in the product. Although high pressure hydrotreating may remove them almost completely, it has been found that the present post-dewaxing solvent extraction technique is particuarly well adapted to remove the components which contribute to poor oxidative stability while retaining those components which are beneficial for maintaining viscosity and additive dispersion. It is believed that polynuclear aromatics tend to be removed by the solvent and that these are the undesirable components for oxidative stability whereas the single ring aromatics which tend to remain in the lube during the extraction are beneficial for additive dispersion and do not significantly affect oxidative stability or product viscosity.

DETAILED DESCRIPTION

The present post-dewaxing aromatic extraction procedure may be used with any petroleum lubricant, that is, any hydrocarbon boiling in the lube boiling range, usually implying an initial boiling point of at least about 600° F. (about 315° C.) and usually above 650° F. (about 345° C.) or higher. Distillate or neutral quality lubes produced by conventional refining techniques will usually have an end point below about 1050° F. (about 565° C.) whereas residual lubes will include components which are not distillable at such temperatures. Typical light to medium neutral stocks may have an IBP below 650° F. (about 345° C.) with an end point below 1000° F. (about 540° C.) whereas heavy neutrals will boil in the 650°-1050° F. (345°-565° C.) range (ASTM D-1160, 10 mm Hg.), typically from 750° to 1050° F. (400°-565° C.) range. Residual feeds (bright stock) usually boil above about 750° F. (about 400° C.) and have a 50% point above 850° F. (about 455° C.) (ASTM D-1160-1, 1 mm. Hg.).

Lube stocks produced by the conventional refining techniques described above may be subjected to an initial solvent extraction to remove aromatics prior to dewaxing but in order to minimise processing steps, the removal of aromatics may be postponed until after the dewaxing and then carried out in one step. In solvent dewaxing, the presence of aromatics in the dewaxing feed may, in fact, be beneficial since the aromatics may act as a non-solvent for the waxy paraffins in the same way as toluene does in the conventional MEK/toluene dewaxing process. Thus, it may be possible to reduce the solvent:oil ratio by omitting the initial aromatics extraction.

The fluidity properties of the lube (freeze point, pour point, cloud point etc.) may be brought to acceptable values by dewaxing, either using a conventional solvent-type process such as MEK/toluene dewaxing or propane dewaxing or by catalytic dewaxing, preferably using a shape-selective intermediate pore size zeolite such as ZSM-5 as the dewaxing catalyst, for example, in one of the catalytic dewaxing processes described above. Conditions during the dewaxing will be adjusted so as to produce the desired target pour point for the dewaxed lube basestock.

Following dewaxing the lube is subjected to extraction of aromatic components by contact with a solvent which is selective for aromatics. Solvents of this type which are particularly applicable with lube feeds include phenol, furfural and N-methyl-2-pyrrolidone although other selective solvents may be employed. The extraction mayl be carried out in a conventional manner with solvent: oil ratios and extraction temperatures and durations adjusted to achieve the desired degree of aromatics removal which is itself determined by the characteristics desired in the final lube product, especially viscosity and oxidation stability. As shown below, the present extraction procedure may be operated so as to minimise changes in product viscosity, viscosity index and pour point while still removing aromatics which have a deleterious effect on oxidation stability.

The temperature and dosage of extraction solvent in this step is controlled to provide high VI products. The fact that the oils to be extracted are already of a low pour point improves the selectivity of the aromatic rejection step in two ways. It improves the miscibility of oil and extraction solvent, and it allows the extraction to be carried out at considerably lower temperaures than would otherwise. Lower extraction temperatures allow very selective rejection of aromatics. For furfural extraction in this proposed process extraction temperatures may now be varied from the usual high of 275° F. to as low as 20° F. Conventional lube processes would not allow temperatures much below 125° F. because of the need to process high pour oils.

The present process is of particular utility with the lubricants produced by the hydroisomerisation-dewaxing process described in Ser. No. 044,187. Reference is made to Ser. No. 044,187 for a description of that process which, for convenience, is also set out below. The final hydrotreating step described in Ser. No. 044,187 will not be required since removal of aromatics is effected by the solvent treatment. The initial wax hydroisomerisation step and the following dewaxing step are, however, used in that same order as described there.

The starting materials used to make the wax-derived lube products are petroleum waxes, that is, waxes of paraffinic character derived from the refining of petroleum and other liquids by physical separation from a wax-containing refinery stream, usually by chilling the stream to a temperature at which the wax separates, usually by solvent dewaxing, e.g., MEK/toluene dewaxing or propane dewaxing. Although the waxes will generally be derived from mineral oils other sources may be used, especially shale oil and synthetic production methods, especially Fischer-Tropsch synthesis which produces highly paraffinic waxes in the high boiling fractions. These waxes have high initial boiling points above about 650° F. (about 345° C.) which render them extremely useful for processing into lubricants which also require an initial boiling point of at least 650° F. (about 345° C.). The presence of lower boiling components is not to be excluded since they will be moved together with higher products produced during the processing during the separation steps which follow the characteristic processing steps. Since these components will reduce the final lube yield and, in addition, will load up the process units they are preferably excluded by suitable choice of feed cut point. The end point of the wax feed will usually be not more than about 1050° F. (about 565° C.) so that they may be classified as distillate rather than residual streams.

The paraffin content of the wax feed is high, generally at least 50, more usually at least 70, weight percent with the balance from occluded oil being divided between aromatics and naphthenics. These waxy, highly paraffinic stocks usually have much lower viscosities than neutral or residual lube stocks because of their relatively low content of aromatics and naphthenes which are high viscosity components. The high content of waxy paraffins, however, gives them melting points and pour points which render them unacceptable as lubricants without further processing.

The wax may suitably be a slack wax, that is, the waxy product obtained directly from a solvent dewaxing process, e.g. an MEK or propane dewaxing process. The slack wax, which is a solid to semi-solid product, comprising mostly highly waxy paraffins (mostly n- and mono-methyl paraffins) together with occluded oil, may be used as such or it may be subjected to an initial deoiling step of a conventional character in order to remove the occluded oil so as to form a harder, more highly paraffinic wax which may then be passed to the hydrocracker. The oil which is removed during the de-oiling step is conventionally and rather curiously known as Foots Oil. The Foots Oil contains most of the aromatics present in the original slack wax and with these aromatics, most of the heteroatoms. Typically, Foots Oil contains 30–40 percent aromatics.

The compositions of some typical waxes are given in Table 1 below.

TABLE 1

| Wax Composition - Arab Light Crude | A | B | C | D |
|---|---|---|---|---|
| Paraffins, wt. pct. | 94.2 | 81.8 | 70.5 | 51.4 |
| Mono-naphthenes, wt. pct. | 2.6 | 11.0 | 6.3 | 16.5 |
| Poly-naphthenes, wt. pct. | 2.2 | 3.2 | 7.9 | 9.9 |
| Aromatics, wt. pct. | 1.0 | 4.0 | 15.3 | 22.2 |

It is preferred that the content of non-paraffins should be kept as low as possible both in order to improve the final lube yield and to obtain the best combination of lube properties. For this reason, a de-oiling step may be desired when dealing with slack waxes with relatively high levels of occluded oil.

Because the feeds are highly paraffinic, the heteroatom content is low and accordingly the feed may be passed directly into the first characteristic process step, the first stage dewaxing hydroisomerization over the zeolite beta catalyst.

First Stage Dewaxing

In this step, the wax feed is subjected to catalytic dewaxing by isomerization over a zeolite beta based catalyst. Although isomerization does not require hydrogen for stoichiometric balance, the presence of hydrogen is desirable in order to promote certain steps in the isomerization mechanism and also to maintain catalyst activity (for this reason, this step of the process is also referred to as a hydroisomerization step). Also, because the isomerization steps entail hydrogenation and dehydrogenation, the catalyst will desirably contain a hydrogenation-dehydrogenation component in addition to the zeolite. The hydrogenation-dehydrogenation component (referred to, for convenience, as a hydrogenation component) is generally a metal or metals of groups IB, IVA, VA, VIA, VIIA or VIIIA of the Periodic Table, preferably of Groups VIA or VIIIA and may be either a base metal such as cobalt, nickel, vanadium, tungsten, titanium or molybdenum or a noble metal such as platinum, rhenium, palladium or gold. Combinations of base metals such as cobalt-nickel, cobalt-molybdenum, nickel-tungsten, cobalt-nickel-tungsten or cobalt-nickel-titanium may often be used to advantage and combinations or noble metals such as platinum-palladium may also be used, as may combinations of base metals with noble metals, such as platinum-nickel. Because the present feeds have a low heteroatom content, the use of noble metals is possible and platinum is the metal component of choice. These metal components may be incorporated into the catalyst by conventional methods such as impregnation using salts of the metals or solutions of soluble complexes which may be cationic, anionic or neutral in type. The amount of the hydrogenation component is typically from 0.01 to 10% by weight of catalyst with the more highly active noble metals being used at lower concentrations, typically from 0.1 to 1% whereas the base metals are normally present in relatively higher concentrations, e.g. 1 to 10%.

Zeolite beta is a known zeolite which is described in U.S. Pat. Nos. 3,308,069 and RE 28,341, to which reference is made for further details of this zeolite, its preparation and properties. The preferred forms of zeolite beta for use in the present process are the high silica forms, having a silica alumina ratio of at least 30:1 and it has been found that ratios of at least 50:1 or even higher, for example, 100:1, 250:1, 500:1, may be used to advantage because these forms of the zeolite are less active for cracking than the less highly siliceous forms so that the desired isomerization reactions are favored at the expense of cracking reactions which tend to effect a bulk conversion of the feed, forming cracked products which are outside the desired boiling range for lube components. Suitable catalysts for use in the present process are described in U.S. Pat Nos. 4,419,220 and 4,518,485, to which reference is made for a more detailed description of these zeolite beta based catalysts. As mentioned in these two patents, the silica:alumina ratios referred to in this specification are the structural or framework ratios and the zeolite, whatever its type, may be incorporated into a matrix material such as clay, silica or a metal oxide such as alumina or silica-alumina.

The zeolite beta catalyst acts by isomerizing the long chain waxy paraffins in the feed to form iso-paraffins which are less waxy in nature but which possess a notably high viscosity index. At the same time, the zeolite will promote a certain degree of cracking or hydrocracking so that some conversion to products outside the lube boiling range will take place. This is not, however, totally undesirable if significant quantities of aromatics are present in the feed since they will then tend to be removed by hydrocracking, with consequent improvements in the viscosity and V.I. of the product. The extent to which cracking reactions and isomerization reactions will predominate will depend on a number of factors, principally the acidity of the zeolite the severity of the reaction (temperature, contact time) and the composition of the feedstock. In general, cracking will be favored over isomerization at higher severities (higher temperature, longer contact time) and with more highly acidic zeolites. Thus, higher silica:alumina ratio in the zeolite will generally favor isomerization and therefore will normally be preferred, except possibly to handle more highly aromatic feeds. The acidity of the zeolite may also be controlled by exchange with alkali metal cations, especially sodium, in order to control the extent to which isomerization occurs relative to cracking. The extent to which isomerization will be favored over cracking will also depend upon the total conversion, itself a factor dependent upon severity. At high conversions isomerization may decrease fairly rapidly at the expense of cracking reactions. Because the present feeds are highly paraffinic it is usually not necessary to go to high levels of conversion:generally conversion will be not more than 50 volume percent per pass and in most cases will be lower, for example, not more than 25 to 35 volume percent to 650° F. (345° C.) products.

The exact conditions selected will depend not only on the character of the feed but also on the properties desired in the final lube product.

For example, with wax feeds with a significant aromatic content, it may be desirable to promote hydrocracking so as to remove the aromatics even at the expense of the resulting yield loss which will ensue, both by aromatics hydrocracking but also by the more or less inevitable paraffin cracking which will accompany it. The effect of catalyst choice and reaction conditions will be generally as described in Ser. No. 793,937, namely, that the more highly acidic zeolites and higher reaction severities will tend to promote hydrocracking reactions over isomerization and the total conversion and choice of hydrogen-dehydrogenation component will also play their parts. Because these will interact in divers ways to affect the result, it is possible here to give no more than this broad indication of what type of result may be obtained from any given selection among the available variables.

Generally, the conditions employed in this step or the process may be described as being of elevated temperature and pressure. Temperatures are normally from 250° C. to 500° C. (about 480° to 930° F.), preferably 370° to 430° C.) (about 700° to 800° F.) but temperatures as low as 200° C. may be used for these highly paraffinic feedstocks. Because the use of lower temperatures tends to favor the desired isomerization reactions over the cracking reactions, the lower temperatures will generally be preferred although it should be remembered that since the degree of cracking which will to some extent inevitably take place will be dependent upon severity, a balance may be established between reaction temperature and average residence time in order to achieve an adequate rate of isomerization while minimizing cracking. Pressures may range up to high values, e.g. up to 25,000 kPa (3,600 psig), more usually in the range 2,000 to 10,000 kPa (275 to 1,435 psig), hydrogen partial pressure at reactor inlet. Space velocity (LHSV) is generally in the range of 0.1 to 5 $hr.^{-1}$, more usually 0.2 to 5 $hr.^{-1}$. The hydrogen:feed ratio is generally from 50 to 1,000 $n.l.l.^{-1}$(about 280 to 5617 SCF/bbl), preferably 200 to 400 $n.l.l.^{-1}$(about 1125 to 2250 SCF/Bbl). Net hydrogen consumption will depend upon the course of the reaction, increasing with increasing hydrocracking and decreasing as isomerization (which is hydrogen-balanced) predominates. The net hydrogen consumption will typically be under about 40 $n.l.l.^{-1}$ (about 224 SCF/Bbl) with the present feeds of relatively low aromatic content such as the slack wax and frequently will be less, typically below 35 $n.l.l.^{-1}$ (about 197 SCF/Bbl). Process configuration will be as described in U.S. Pat. Nos. 4,419,220 and 4,518,485, i.e. with downflow trickle bed operation being preferred.

Selection of the severity of the dewaxing operation is an important part of the present process because it is not possible to remove the straight chain and slightly branched chain waxy components in a completely selective manner, while retaining the desirable more highly branch chain components which contribute to high V.I. in the product. For this reason, the degree of dewaxing which is achieved in the hydroisomerisation, is limited so as to leave a residual quantity of waxy components which are then removed in the second selective dewaxing step. The objective of maximizing the isoparaffinic content of the effluent from the catalytic dewaxing step so as to obtain the highest V.I. in the final product may be achieved by adjusting the severity of the initial dewaxing operation until the optimum conditions are reached for this objective. As the contact time between the catalyst and the feed is extended, the catalyst will effect some cracking besides the desired paraffin isomerization reactions so that the iso-paraffins which are formed by the isomerization reactions as well as the isoparaffins originally present in the feed will become subjected to conversion as the contact time becomes longer. Thus, once catalyst type and temperature are selected, the most significant variable in the process from the point of view of producing the products with the best balance of qualities is the contact time between the feed and the catalyst, relative to catalytic activity. Again, because the catalyst will age as the process continues, the optimum contact time will need to be varied itself as a function of increasing operational duration. As a general guide, the contact time (1/LHSV) under typical conditions will generally be less than 0.5 hours in order to maximize the isoparaffinic content of the catalytically dewaxed effluent. However, if lower pour points are desired, longer contact times, typically up to one hour may be employed and in cases where an extreme reduction in pour point is desired, up to two hours.

Although the process is best characterized in terms of the effects which are achieved at each step, practical considerations may dictate that somewhat less than optimum conditions be used in order to minimize analytical work. As a general guide, the minimum amount of dewaxing which occurs during the initial dewaxing step should be such that the pour point of the catalytically dewaxed effluent is reduced by at least 10° F. (5.5° C.) and preferably by at least 20° F. (11° C.). The maximum amount of dewaxing in the initial dewaxing step should be such that the pour point of the first stage effluent is not lower than 10° F. (5.5° C.), preferably 20° F. (11° C.), above the target pour point for the desired product. This range of partial dewaxing by isomerization will generally be found to maximize isoparaffin production so as to produce a product of low pour point with a high V.I. However, these figures are given as a general guide and naturally, if wax feeds of extremely high pour point are used, or if the target pour point for the product is extremely low, it may be necessary or desirable to depart from these approximate figures. Generally, many feeds will have pour points in the range of about 25° to 90° C. (about 75° to 195° F.) unless, like slack wax, they are solid at ambient temperatures. Product pour points are generally in the range −5° to 55° C. (about 23° to −67° F.) and it is therefore usually possible to carry out the dewaxing steps within the limits set out above. Pour point of 10° to 20° F. for the intermediate, partly dewaxed product are preferred.

The effluent from the first step dewaxing step may be subjected to fractionation to separate lower boiling fractions out of the lube boiling range, usually 345° C. (about 650° F.), before passing the intermediate product to the second stage, selective dewaxing. Removal of the lower boiling products, together with any inorganic nitrogen and sulfur formed in the first stage is preferred in order to facilitate control of the pour point of the second stage product if solvent dewaxing is used.

Selective Dewaxing

The effluent from the initial hydroisomerisation step still contains quantities of the more waxy straight chain, n-paraffins, together with the higher melting non-normal paraffins. Because these contribute to unfavorable pour points, and because the effluent will have a pour point which is above the target pour point for the product, it is necessary to remove these waxy components. To do this without removing the desirable isoparaffinic components which contribute to high V.I. in the product, a selective dewaxing step is carried out. This step removes the n-paraffins together with the more highly waxy, slightly branched chain paraffins, while leaving the more branched chain iso-paraffins in the process stream. Conventional solvent dewaxing processes may be used for this purpose because they are highly selective for the removal of the more waxy components including the n-paraffins and slightly branched chain paraffins, as may catalytic dewaxing processes which are more highly selective for removal of n-paraffins and slightly branched chain paraffins. This step of the process is therefore carried out as described in Ser. No. 793,937, to which reference is made for a description of this step. As disclosed there, solvent dewaxing may be used or catalytic dewaxing and if catalytic dewaxing is employed, it is preferably with a selectivity greater than that of ZSM-5. Thus, catalytic dewaxing with a highly shape selective dewaxing catalyst based on a zeolite with a constraint index of at least 8 is preferred with ZSM-23 being the preferred zeolite, although other highly shape-selective zeolites such as the synthetic ferrierite ZSM-35 may also be used, especially with lighter stocks. Typical dewaxing processes of this type are described in the following U.S. Pat. Nos.: 3,700,585 (Re 28,398), 3,894,938, 3,933,974, 4,176,050, 4,181,598, 4,222,855, 4,259,170, 4,229,282, 4,251,499, 4,343,692 and 4,247,388.

The dewaxing catalyst used in the catalytic dewaxing will normally include a metal hydrogenation-dehydrogenation component of the type described above; even though it may not be strictly necessary to promote the selective cracking reactions, its presence may be desirable to promote certain isomerization mechanisms which are involved in the cracking sequence, and for similar reasons, the dewaxing is normally carried out in the presence of hydrogen, under pressure. The use of the metal function also helps retard catalyst aging in the presence of hydrogen and, may also increase the stability of the product. The metal will usually be of the type described above, i.e. a metal of Groups IB, IVA, VA, VIA, VIIA or VIIIA, preferably of Groups VIA or VIIIA, including base metals such as nickel, cobalt, molybdenum, tungsten and noble metals, especially platinum or palladium. The amount of the metal component will typically be 0.1 to 10 percent by weight, as described above and matrix materials and binders may be employed as necessary.

Shape selective dewaxing using the highly constrained, highly shaped-selective catalysts zeolite may be carried out in the same general manner as other catalytic dewaxing processes, for example, in the same general manner and with similar conditions as those described above for the initial catalytic dewaxing step. Thus, conditions will generally be of elevated temperature and pressure with hydrogen, typically at temperatures from 250° to 500° C. (about 480° F. to 930° F.), more usually 300° to 450° C. (about 570° F. to 840° F.) and in most cases not higher than about 370° C. (about 700° F.), pressures up to 25,000 kPa, more usually up to 10,000 kPa, space velocities of 0.1 to 10 $hr^{-1}$ (LHSV), more usually 0.2 to 5 $hr^{-1}$, with hydrogen circulation rates of 500 to 1000 $n.l.l.^{-1}$, more usually 200 to 400 $n.l.l.^{-1}$. Reference is made to Ser. No. 793,937 for a more extended discussion of the catalytic dewaxing step.

If solvent dewaxing is used, the wax by-product from the solvent dewaxing may be recycled to the process to increase the total lube yield. If necessary, the recycled slack wax by-product may be de-oiled to remove aromatics concentrated in the oil fraction and residual heteroatom-containing impurities. Use of the solvent dewaxing with recycle of the wax to the hydroisomerization step provides a highly efficient process which is capable of providing yield lube yields. Based on the original wax feed, the yield following the hydroisomerization-solvent dewaxing sequence it typically at least 50 volume percent and usually at least 60 volume percent or even higher, for instance, 65 volume percent, of high V.I., low pour point lube. Solvent dewaxing may be used in combination with catalytic dewaxing, with an initial solvent dewaxing followed by catalytic dewaxing to the desired final pour point and recycle of the separated wax from the solvent process.

The furfural treatment improves significantly the oxidative stability of slack wax-derived lube base stock. Furthermore it provides the product quality comparable to that obtained from the high pressure post-hydrotreating. In addition, the solvent treatment offers the benefit of increasing slightly the lube viscosity as compared to the viscosity loss observed with post-hydrotreating step. Since the extraction step is an integral part of lube complex, the implementtion of the combined solvent wax isomerisation-solvent extraction process is readily feasible.

EXAMPLE 1

A heavy neutral slack wax of North Sea crude origin was subjected to hydroisomeristion. The wax had the following composition:

TABLE 2

| North Sea HN | |
|---|---|
| API Gravity | 36.3 |
| H, wt pct | 14.3 |
| S, wt pct | 0.082 |
| N, ppmw | 40 |
| Melting Point, °F. | 152 |
| Aniline Point, °F. | 265 |
| KV @ 212° F. (100° C.) | 8.525 |
| @ 300° F. (149° C.) | 3.849 |
| Oil Content, wt pct | 18 |
| Distillation, °F. (D1160) | |
| IBP | 764 |
| 10 | 916 |
| 30 | 947 |
| 50 | 967 |
| 70 | 990 |
| 90 | 1022 |
| 95 | 1036 |
| EP | 1054 |

The isomerisation was carried out over a 0.6 wt pct Pt/zeolite beta catalyst (35% zeolite .65% alumina binder) at 400 psig hydrogen pressure, 760° F., 1 LHSV (2860 kPa abs, 405° C., 1.3 $hr^{-1}$). The total liquid product was then fractionated to obtain a 650° F.+ (about 345° C.+) hydroisomerised lube fraction which was then solvent dewaxed (60/40v/v MEK/toluene solvent, 3:1 solvent:oil, 100% washing at filtration temperature of −10° F./−23° C.) to yield 45 wt pct dewaxed lube base stock having the properties set out in Table 3 below.

TABLE 3

| Dewaxed Hydroisomerised Slack Wax | |
|---|---|
| API Gravity | 34.8 |
| H, wt pct | 14.30 |
| S, wt pct | 0.002 |
| N, wt pct | 0 |
| Pour Point, °F. (°C.) | +10 (+12) |
| Molecular Wt | 439 |
| KV @ 40° C., cSt | 32.08 |
| @ 100° C., cSt | 6.097 |
| Visc., SUS @ 100° F.(38° C.) | 164 |
| VI | 140 |
| Sim. Dist., °F. (D2887) | |
| 5% | 679 |
| 10% | 716 |
| 30% | 839 |
| 50$ | 914 |
| 70% | 963 |
| 90% | 1021 |
| 95% | 1041 |

EXAMPLE 2

The dewaxed lube obtained from the Example 1 was hydrotreated at high pressure over a conventional $NiMo/Al_2O_3$ HDT catalyst (Cyanamid HDN-30) at 2000 psig, 650° F., 1 LHSV (13890 kPa, 345° C., 1 $hr^{-1}$) to remove unsaturates including aromatics. The aromatics content in the lube was reduced from 21 to 2 wt pct. The lube properties before and after the high pressure post-hydrotreating are as follows:

TABLE 4

| Hydrotreating Dewaxed Lube | Before HDT | After HDT |
|---|---|---|
| Pour Point, °F. (°C.) | +10(−12) | +15(−9) |
| KV @ 40° C., cSt | 32.08 | 30.44 |
| @ 100° C., cSt | 6.097 | 5.920 |
| Viscosity Index | 140 | 143 |
| Aromatics, wt pct | 21 | 2 |

The results indicate that post-hydrotreating decreases the lube aromatics content as well as the viscosity.

EXAMPLE 3

Instead of high pressure post Example 2, the dewaxed lube obtained from the Example 1 was extracted with furfural (1000 vol % dosage, 142° F./61° C.). The effect of pOst-furfural treatment on the lube properties Is shown below:

TABLE 5

| Furfural Extraction of Dewaxed Lube | Before Extraction | After Extraction |
|---|---|---|
| Pour, °F. | +10 (−12) | +10 (−12) |
| KV @ 40° C., cSt | 32.08 | 32.90 |
| @ 100° C., cSt | 6.097 | 6.307 |
| Viscosity Index | 140 | 145 |
| Aromatics, wt pct | 21 | 15 |

As compared to the post-hydrotreating step shown in Example 2, the furfural treatment does not significantly reduce the aromatics concentration, but the lube viscosity is increased slightly.

EXAMPLE 4

This example compares the effect of post-hydrotreating versus post-furfural extraction on the oxidative stability of the dewaxed lube base stock. The dewaxed lubes obtained from Example 1,2 and 3 were blended with a commercial additive package and submitted for RBOT and B-10 measurements. The following results were obtained:

TABLE 6

| Lube Stock | Dewaxed | Post-HDT | Post-Furfural |
|---|---|---|---|
| Example No. | 1 | 2 | 3 |
| Product Quality | | | |
| Aromatics, wt pct | 21 | 2 | 15 |
| RBOT, minutes | 190 | 245 | 235 |
| B-10, pct Visc. Inc. @ 300° F. for 60 Hrs | 92 | 3 | 2 |

The post-furfural treatment improves the dewaxed lube oxidative stability to the level of that obtained from high pressure post-hydrotreating even with higher aromatics content (15 vs. 2 wt %).

NOTE:

(1) The RBOT test protocol is described in ASTM D2272.

(2) The B-10 oxidation test is used to evaluate mineral oil and synthetic lubricants either with or without additives. The evaluation is based on the resistance of the lubricant to oxidation by air under specified conditions as measured by the formation of sludge, the corrosion of a lead specimen, and changes in neutralization number and viscosity. In this method, the sample is palced in a glass oxidation cell together with iron, copper and aluminum catalysts and a weighed lead corrosion specimen. The cell and its contents are placed in a bath maintained at a specified temperature and a measured volume of dried air is bubbled through the sample for the duration of the test. The cell is removed from the bath and the catalyst assembly is removed from the cell. The oil is examined for the presence of sludge and the Neutralization Number (ASTM D664) and Kinematic Viscosity at 100° C. (ASTM D445) are determined. The lead specimen is cleaned and weighed to determine the loss in weight.

We claim:

1. A process for producing a lubricant of improved oxidative stability and additive solubility characteristics, which method comprises:

(i) solvent dewaxing a hydrocarbon fraction to produce a separated wax, (ii) hydroisomerizing the wax to form a fraction of lower pour point (iii) dewaxing the fraction of lower pour point to form a dewaxed lube fraction (iv) subjecting the dewaxed lube fraction to solvent extraction using a solvent selective for aromatics to remove selectively a portion of the aromatics in the dewaxed lube fraction and form a solvent-extracted lubricant fraction containing from 5 to 20 wt. percent aromatics.

2. A process according to claim 1 in which the separated wax is subjected to de-oiling before being hydroisomerized.

3. A process according to claim 1 in which the separated wax is hydroisomerized by contact with zeolite beta.

4. A process according to claim 1 in which the fraction of lower pour point is catalytically dewaxed to form the dewaxed lube fraction.

5. A process according to claim 4 in which the fraction of lower pour point is catalytically dewaxed in the presence of a dewaxing catalyst comprising ZSM-5.

6. A process according to claim 4 in which the fraction of lower pour point is catalytically dewaxed in the presence of a dewaxing catalyst comprising ZSM-23.

7. A process according to claim 1 in which the solvent extraction is carried out using phenol, furfural or N-methyl-pyrrolidone as the solvent.

8. A process according to claim 1 in which the solvent extraction is carried out using furfural, as the solvent.

9. A process according to claim 1 in which not more than 50 wt. percent of aromatic components are removed from the dewaxed lube fraction during the solvent extraction.

10. A process according to claim 1 in which the solvent extracted lubricant contains 10 to 20 wt. percent aromatics.

* * * * *